US012472396B2

(12) United States Patent
Wang

(10) Patent No.: US 12,472,396 B2
(45) Date of Patent: Nov. 18, 2025

(54) BENCH PRESS TRAINING MACHINE WITH VARIABLE ARMS OF FORCE

(71) Applicant: Shandong Li De Fitness Co., Ltd, Tai'an (CN)

(72) Inventor: Fujian Wang, Tai'an (CN)

(73) Assignee: Shandong Li De Fitness Co., Ltd, Tai'an (CN)

( * ) Notice: Subject to any disclaimer, the term of this patent is extended or adjusted under 35 U.S.C. 154(b) by 256 days.

(21) Appl. No.: 18/364,672

(22) Filed: Aug. 3, 2023

(65) Prior Publication Data

US 2023/0414989 A1 Dec. 28, 2023

Related U.S. Application Data

(63) Continuation of application No. PCT/CN2023/102024, filed on Jun. 25, 2023.

(30) Foreign Application Priority Data

Jun. 28, 2022 (CN) ..... 202221623320.9

(51) Int. Cl.
*A63B 21/078* (2006.01)
*A63B 21/00* (2006.01)
(Continued)

(52) U.S. Cl.
CPC ..... *A63B 21/078* (2013.01); *A63B 21/00181* (2013.01); *A63B 21/0632* (2015.10);
(Continued)

(58) Field of Classification Search
CPC ..... A63B 2225/09; A63B 2208/0252; A63B 23/02; A63B 23/12; A63B 21/0632; A63B 21/078; A63B 21/00181
See application file for complete search history.

(56) References Cited

U.S. PATENT DOCUMENTS 5,116,297 A * 5/1992 Stonecipher ..... A63B 21/4035 482/137
5,562,577 A * 10/1996 Nichols, Sr. ..... A63B 21/078 482/137

(Continued)

FOREIGN PATENT DOCUMENTS

CN 208274936 U 12/2018
CN 111494876 A 8/2020
CN 217854327 U 11/2022

*Primary Examiner* — Zachary T Moore

(57) ABSTRACT

The present utility model relates to a bench press training machine with variable arms of force, including: a machine frame; a longitudinal supporting cushion plate, fixedly connected to the machine frame; and two swinging arms, articulated with the machine frame respectively, where the two swinging arms are arranged on the left and right sides of the supporting cushion plate respectively, the swinging arms extend forward and backward, with the front ends being articulated with the machine frame, and the swinging arms are provided with handles. The training machine further includes: two adjusting pull rods; and adjusting arms, articulated with the swinging arms, where weight plate shafts are fixedly connected to the adjusting arms, the front ends of the adjusting pull rods are articulated with the machine frame, and the rear ends of the adjusting pull rods are articulated with the adjusting arms.

15 Claims, 5 Drawing Sheets

(51) Int. Cl.
*A63B 21/062* (2006.01)
*A63B 23/02* (2006.01)
*A63B 23/12* (2006.01)

(52) U.S. Cl.
CPC ..... *A63B 23/02* (2013.01); *A63B 23/12* (2013.01); *A63B 2208/0252* (2013.01); *A63B 2225/09* (2013.01)

(56) References Cited

U.S. PATENT DOCUMENTS 5,582,564 A * 12/1996 Nichols, Sr. ..... A63B 21/078 482/137
5,769,757 A * 6/1998 Fulks ..... A63B 23/03525 482/137
6,203,474 B1 * 3/2001 Jones ..... A63B 23/03541 482/97
6,244,996 B1 * 6/2001 Sencil ..... A63B 21/0617 482/137
6,254,516 B1 * 7/2001 Giannelli ..... A63B 23/1209 482/136
6,350,219 B1 * 2/2002 Hobson ..... A63B 21/0615 482/137
7,938,760 B1 * 5/2011 Webber ..... A63B 21/15 482/137
2021/0197010 A1 * 7/2021 Webber ..... A63B 23/03541

* cited by examiner

BENCH PRESS TRAINING MACHINE WITH VARIABLE ARMS OF FORCE

CROSS-REFERENCE TO RELATED APPLICATIONS

This application is a continuation of International Patent Application No. PCT/CN2023/102024 with a filing date of Jun. 25, 2023, designating the United States, and further claims priority to Chinese Patent Application No. 202221623320.9 with a filing date of Jun. 28, 2022. The content of the aforementioned applications, including any intervening amendments thereto, are incorporated herein by reference.

TECHNICAL FIELD

The present utility model relates to the field of fitness equipment, and in particular to the field of chest fitness equipment, and specifically to a bench press training machine with variable arms of force.

BACKGROUND

Bench press is the basic training for exercising the pectoralis major, and the deltoid and the triceps can also be exercised. Compared with seated chest press, bench press can achieve training with heavier weights and has a better training stimulation effect on the chest. During bench press training, since handles are close to the body at the beginning of upward push, it is the most difficult to push upward at this moment. As the handles move away from the body, the arms are getting straighter and straighter, and the trainee is feeling more and more relaxed. Therefore, in order to smoothly push upward, a lighter weight can only be chosen, resulting in the training effect in the later stage of the upward push failing to effectively meet training requirements. Therefore, there is a lack of a bench press training machine with an upward push resistance increasing in the process of upward push.

SUMMARY

Aiming at the defects of the prior art, the present utility model provides a bench press training machine with variable arms of force, which allows the upward push resistance to increase in the process of upward push.

The present utility model is implemented through the following technical scheme. Provided is a bench press training machine with variable arms of force, including: a machine frame; a longitudinal supporting cushion plate, fixedly connected to the machine frame; and two swinging arms, articulated with the machine frame respectively, where the two swinging arms are arranged on the left and right sides of the supporting cushion plate respectively, the swinging arms extend forward and backward, with the front ends being articulated with the machine frame, and the swinging arms are provided with handles; the bench press training machine further includes: two adjusting pull rods; and adjusting arms, articulated with the swinging arms, where weight plate shafts are fixedly connected to the adjusting arms, the front ends of the adjusting pull rods are articulated with the machine frame, and the rear ends of the adjusting pull rods are articulated with the adjusting arms.

During training, weight plates are mounted onto the weight plate shafts, a user lies in a supine position on the longitudinal supporting cushion plate and holds the handles with both hands, and the swinging arms can swing upward by pushing upward, thereby realizing bench press training. Since the weight plate shafts are fixedly connected to the adjusting arms and the adjusting arms are articulated with the swinging arms, as the swinging arms swing upward, the adjusting arms are driven by the adjusting pull rods to swing backward, so that arms of force from the weight plates on the weight plate shafts to articulation points are lengthened, and thereby, with the increase of an upward push distance, the push force of the user has to be increased, achieving a better training effect.

As an optimization, lower ends of the adjusting arms are articulated with the swinging arms, the adjusting pull rods extend forward and backward and are located above the swinging arms, and articulating shafts between the adjusting pull rods and the machine frame are higher than articulating shafts between the swinging arms and the machine frame. In this scheme, since the articulating shafts between the adjusting pull rods and the machine frame are higher than the articulating shafts between the swinging arms and the machine frame, the adjusting pull rods and the swinging arms form a four-point articulated parallelogram structure, so that the adjusting arms can swing backward as the swinging arms swing upward.

As an optimization, the articulating shafts between the swinging arms and the machine frame extend leftward and rightward, and the articulating shafts of the two swinging arms are arranged in a V shape. In this scheme, since the articulating shafts of the two swinging arms are arranged in a V shape, as the swinging arms swing upward, the distance between the two swinging arms becomes smaller, thereby achieving a better training effect.

As an optimization, the handles are fixedly connected to the rear ends of the swinging arms and are arranged horizontally. In this scheme, since the handles are horizontally arranged at the rear ends, it is convenient for the user to hold the handles.

As an optimization, buffer blocks that support the swinging arms are fixedly connected to the machine frame. The buffer blocks in this scheme play the role of supporting and buffering the swinging arms.

As an optimization, both ends of each adjusting pull rod are connected through ball joints. In this scheme, since both ends of each adjusting pull rod are connected through ball joints, the interference jamming of the adjusting pull rods is prevented in the process of adjustment.

As an optimization, the bench press training machine further includes a assisting mechanism which includes assisting arms articulated with the machine frame, where assisting jacking blocks located below the swinging arms are fixedly connected to the assisting arms, and the assisting mechanism also includes a driving mechanism which drives the assisting jacking blocks on the assisting arms to swing upward. When the assisting mechanism in this scheme is pushed up, the driving mechanism is operated to drive the assisting arms to swing, and the assisting jacking blocks on the assisting arms swing upward to push the swinging arms upward, achieving an assisting effect.

As an optimization, the driving mechanism includes a pedal pull rod which is articulated with the machine frame, the pedal pull rod is connected to the assisting arms, and the rear end of the pedal pull rod extends to the rear of the supporting cushion plate. In this scheme, since the rear end of the pedal pull rod extends to the rear of the supporting cushion plate, when the feet of the user press down on the rear end of the pedal pull rod, the pedal pull rod is driven to swing, and the swing of the pedal pull rod drives the assisting arms to swing.

The present utility model has the following beneficial effects: according to the bench press training machine with variable arms of force provided in the present utility model, when a user pushes the swinging arms to swing upward, the adjusting arms are driven by the adjusting pull rods to swing backward, so that arms of force from the weight plates on the weight plate shafts to the articulation points are lengthened, and thereby, with the increase of the upward push distance, the push force of the user has to be increased, achieving a better training effect; the acting force can be optimized, and torque compensation is performed with the rotation of the arms of force to enable the user to get better exercise; and in addition, by providing the assisting mechanism, the user's own upward push can be utilized for assistance, without needing the assistance of another person.

DESCRIPTION OF REFERENCE NUMERALS

1. machine frame, 2. supporting cushion plate, 3. swinging arm, 4. handle, 5. adjusting arm, 6. weight plate shaft, 7. adjusting pull rod, 8. supporting block, 9. buffer block, 10. assisting arm, 11. assisting jacking block, 12. assisting pull rod, 13. first connecting rod, 14. rotating shaft, driving pull rod, 16. pneumatic jacking rod, 17. pedal pull rod, 18. second connecting rod, 19. limit buffer block, and 20. pedal.

DETAILED DESCRIPTION

In order to clearly illustrate the technical features of this scheme, the scheme will be described below through specific implementations.

Figure 1:
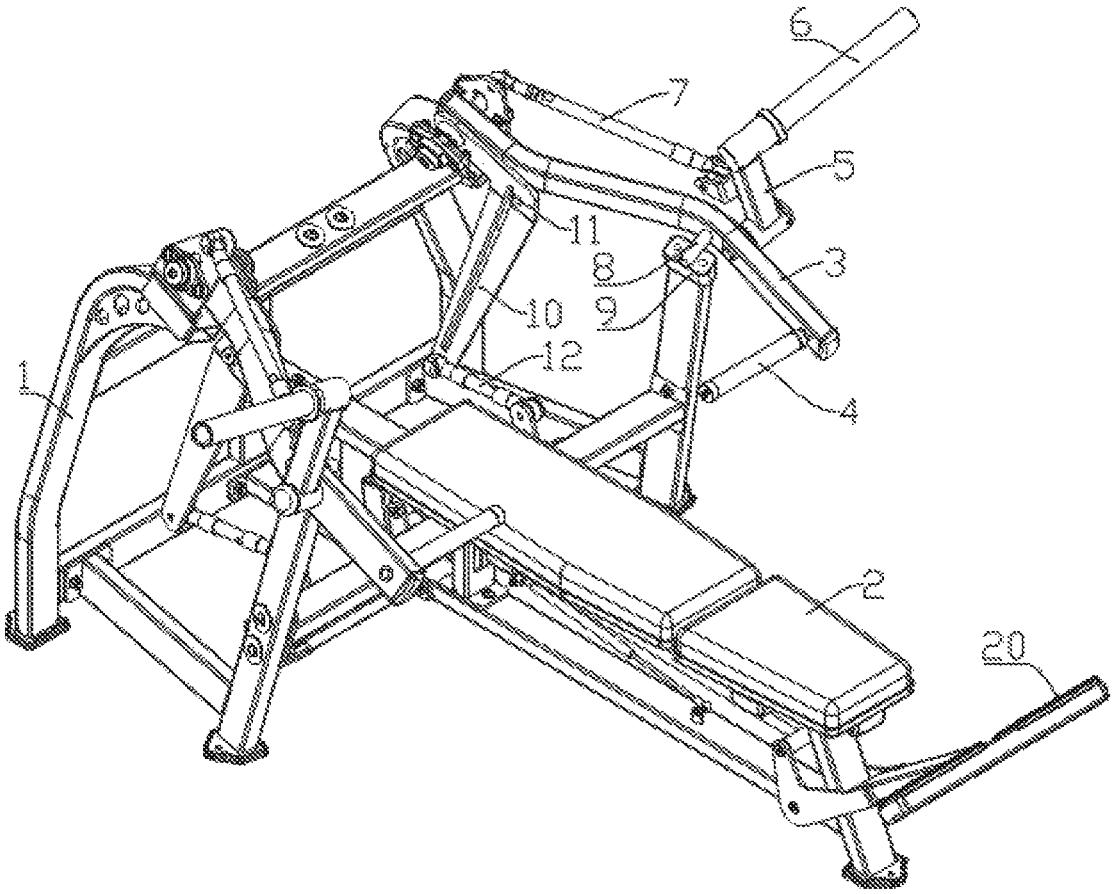
FIG. 1 is a schematic structural diagram of the present utility model.
Figure 2:
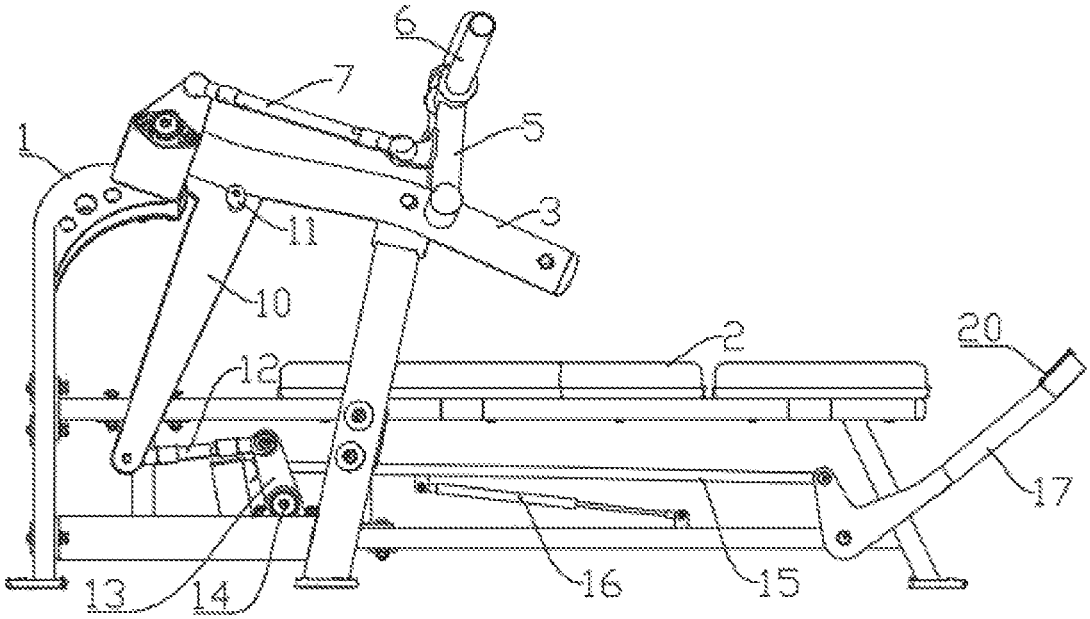
FIG. 2 is a front view of the present utility model.
Figure 3:
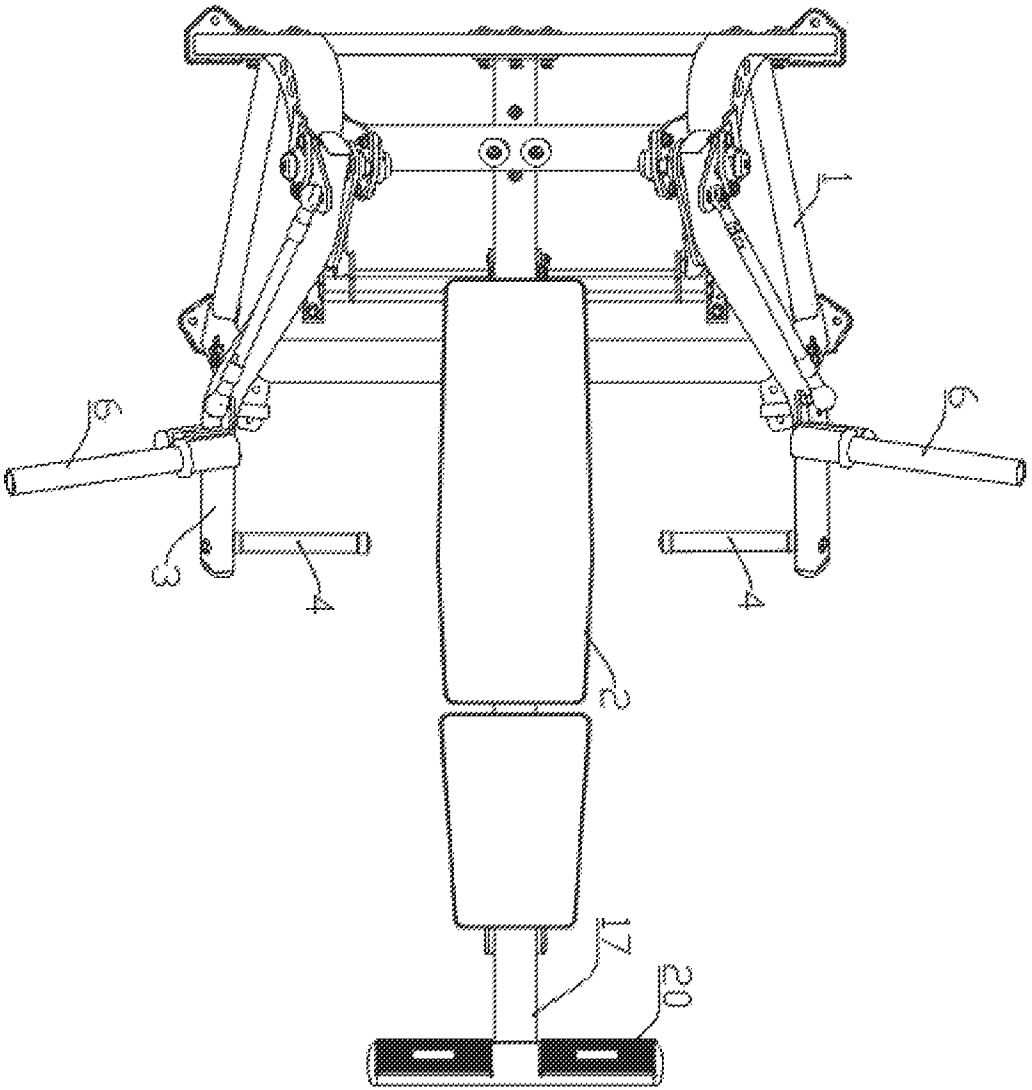
FIG. 3 is a top view of the present utility model.
Figure 4:
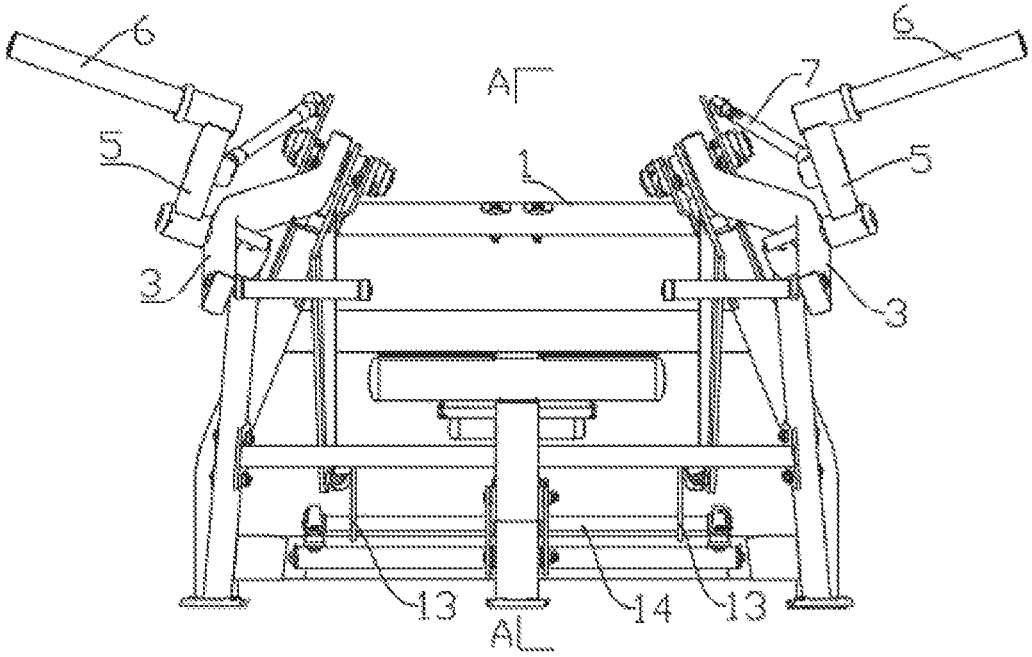
FIG. 4 is a right view of the present utility model.
Figure 5:
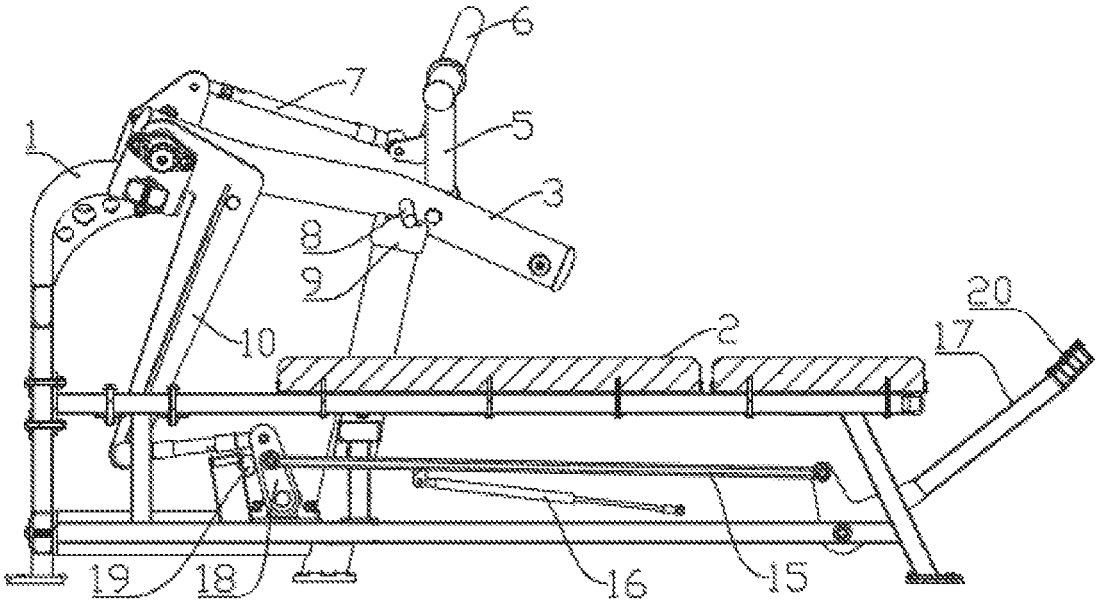
FIG. 5 is a sectional view of A-A side in FIG. 4 of the present utility model.

As shown in FIGS. 1 to 5, a bench press training machine with variable arms of force according to the present utility model includes a machine frame 1, a longitudinal supporting cushion plate 2 fixedly connected to the machine frame 1, and two swinging arms 3 articulated with the machine frame 1 respectively. The machine frame 1 is fixedly placed on the ground as a fixed frame body of the entire training machine.

The upper end surface of the supporting cushion plate 2 is a strip-shaped leather-wrapped sponge cushion for supporting the head, back and buttocks of a user. In this scheme, the front refers to the direction of the head when the user lies in a supine position on the supporting cushion plate 2, and the rear refers to the direction of the legs.

The swinging arms 3 extend forward and backward, with the front ends being articulated with the machine frame 1. Buffer blocks 9 that support the swinging arms 3 are fixedly connected to the machine frame. The buffer blocks 9 are rubber blocks for supporting the swinging arms 3 in a static state. At this point, the height of the rear ends of the swinging arms 3 is lower than the height of the front ends thereof, so that the swinging arms 3 can swing upward to a horizontal position during training. The resistance which the user has to overcome is greatest at the horizontal position.

Articulating shafts between the swinging arms 3 and the machine frame 1 extend leftward and rightward, so that the swinging arms 3 can swing up and down, and the articulating shafts of the two swinging arms 3 are arranged in a V shape, so that, as the swinging arms swing upward, the distance between the two swinging arms becomes smaller, thereby achieving a better training effect.

The swinging arms 3 are provided with handles 4, which are fixedly connected to the rear ends of the swinging arms 3 and are arranged horizontally. The handles 4, which are fixedly connected to the inner sides of the two swinging arms 3, are round rods and generally covered with rubber, so as to increase friction.

The bench press training machine further includes two adjusting pull rods 7 and adjusting arms 5, and the adjusting arms 5 are articulated with the swinging arms 3. Lower ends of the adjusting arms 5 are articulated with the swinging arms 3, so that the upper ends of the adjusting arms 5 can swing back and forth. The two adjusting pull rods 7 correspond to the two adjusting arms, respectively. The front ends of the adjusting pull rods 7 are articulated with the machine frame 1, and the rear ends of the adjusting pull rods 7 are articulated with the adjusting arms 5. Both ends of each adjusting pull rod 7 are connected through ball joints.

In the present embodiment, the adjusting pull rods 7 extend forward and backward and are located above the swinging arms 3. Articulating shafts between the adjusting pull rods 7 and the machine frame 1 are higher than the articulating shafts between the swinging arms 3 and the machine frame, so that the adjusting pull rods 7 and the swinging arms 3 form a four-point articulated parallelogram structure, and thus the adjusting arms 5 can swing backward as the swinging arms 3 swing upward.

The swinging arms 3 are provided with weight plate shafts 6, which are fixedly connected to the adjusting arms 5. In the present embodiment, the weight plate shafts 6 are horizontally and fixedly connected to the upper ends of the adjusting arms 3, with the ends being inclined upward, thereby preventing the weight plates from dropping.

The bench press training machine further includes an assisting mechanism, which includes assisting arms 10 articulated with the machine frame 1. There are two assisting arms 10 arranged to correspond to the two swinging arms respectively. The front ends of the upper ends of the assisting arms 10 are articulated with the machine frame 1, and articulating shafts between the assisting arms 10 and the machine frame 1 are coaxial with the articulating shafts between the swinging arms 3 and the machine frame 1, so that the rear ends of the assisting arms 10 can swing up and down and the lower ends can swing back and forth.

Assisting jacking blocks 11 located below the swinging arms 3 are fixedly connected to the assisting arms 10. The assisting jacking blocks 11 are fixedly connected behind the articulating shafts of the assisting arms 10, so that upward and downward swinging can be realized through the swing of the assisting arms. During upward swinging, the swinging arms 3 are pushed upward to realize assistance during upward push.

The assisting mechanism also includes a driving mechanism which can drive the assisting jacking blocks 11 on the assisting arms 10 to swing upward. The driving mechanism includes a pedal pull rod 17 which is articulated with the machine frame 1. The lower end of the pedal pull rod 17 is articulated with the machine frame 1 with an articulating shaft extending horizontally leftward and rightward, so that the rear end of the pedal pull rod 17 can swing up and down. The rear end of the pedal pull rod 17 extends to the rear of the supporting cushion plate 2, and is fixedly connected to a pedal 20. In an initial state, the height of the rear end of the pedal pull rod 17 is close to the height of the supporting cushion plate 2. The feet of the user press down on the pedal 20, so that the pedal pull rod 17 swings.

The pedal pull rod 17 is connected to the assisting arms 10, and the rear end of the pedal pull rod 17 can swing downward to realize the forward and backward swing of lower ends of the assisting arms 10. In order to realize the connection between the pedal pull rod 17 and the assisting arms 10, the driving mechanism also includes a rotating shaft 14, which is axially connected to the machine frame 1 and extends leftward and rightward.

The rotating shaft 14 is fixedly connected to a second connecting rod 18. The second connecting rod 18 is vertically and fixedly connected to an upper end of the middle portion of the rotating shaft 14, and is connected to the pedal pull rod 17 through a driving pull rod 15. The front end of the driving pull rod 15 is articulated with the upper end of the second connecting rod 18, and the rear end of the driving pull rod 15 is articulated with the front end of the pedal pull rod 17. An articulating shaft between the driving pull rod 15 and the pedal pull rod 17 is higher than an articulating shaft between the pedal pull rod 17 and the machine frame 1, so that the rear end of the pedal pull rod 17 can swing downward to drive the driving pull rod 15 to move backward.

The rotating shaft 14 is fixedly connected to two first connecting rods 13. The two first connecting rods 13 are vertically and fixedly connected to both ends of the upper end of the rotating shaft 14 respectively, and are connected to the two assisting arms 10 through assisting pull rods 12 respectively. The front ends of the assisting pull rods 12 are articulated with the lower ends of the assisting arms 10, and the rear ends of the assisting pull rods 12 are articulated with upper ends of the first connecting rods 13. Moreover, all the articulating shafts horizontally extend leftward and rightward.

The driving mechanism also includes a pneumatic jacking rod 16 which can drive the rear end of the pedal pull rod 17 to swing upward. The front end of the pneumatic jacking rod 16 in the present embodiment is articulated with the driving pull rod 15, and a rear end is articulated with the machine frame 1. By pushing the driving pull rod 15 forward, the rear end of the pedal pull rod 17 swings upward for restoration.

The method for using the present utility model is as follows:

During training, weight plates with a proper weight are mounted onto the weight plate shafts 6, a user lies in a supine position on the longitudinal supporting cushion plate 2 and holds the handles 4 with both hands, and the swinging arms 3 can swing upward by means of upward push, thereby realizing bench press training. During the upward push, the feet of the user press down on the rear end of the pedal pull rod 17, so that the pedal pull rod 17 is driven to swing, and the swing of the pedal pull rod 17 drives the assisting arms 10 to swing, so that the assisting jacking blocks 11 on the assisting arms swing upward to push the swinging arms 3 upward, achieving an assisting effect.

As the swinging arms 3 swing upward, the adjusting arms 5 are driven by the adjusting pull rods 7 to swing backward, so that arms of force from the weight plates on the weight plate shafts 6 to articulation points are lengthened, and thereby, with the increase of an upward push distance, the push force of the user has to be increased, achieving a better training effect.

Certainly, the above description is not limited to the above examples, and the undescribed technical features of the present utility model may be implemented by or using the prior art, which will not be repeated here. The above embodiments and accompanying drawings are only used to illustrate the technical solutions of the present utility model rather than to limit the present utility model. The present utility model has been described in detail with reference to preferred embodiments. Those of ordinary skill in the art should understand that changes, modifications, additions, or substitutions which are made by those of ordinary skill in the art within the essential scope of the present utility model without departing from the purpose of the present utility model shall also fall within the protection scope of the claims of the present utility model.

What is claimed is:

1. A bench press training machine with variable arms of force, comprising:

a machine frame, a longitudinal supporting cushion plate fixedly connected to the machine frame;

two swinging arms articulated with the machine frame respectively, wherein the two swinging arms are arranged on left and right sides of the supporting cushion plate respectively, the swinging arms extend forward and backward, front ends of the swinging arms are articulated with the machine frame, and the swinging arms are provided with handles;

two adjusting pull rods, and adjusting arms articulated with the swinging arms, wherein weight plate shafts are fixedly connected to the adjusting arms, front ends of the adjusting pull rods are articulated with the machine frame, and rear ends of the adjusting pull rods are articulated with the adjusting arms;

wherein lower ends of the adjusting arms are articulated with the swinging arms, the adjusting pull rods extend forward and backward and are located above the swinging arms, and articulating shafts between the adjusting pull rods and the machine frame are higher than articulating shafts between the swinging arms and the machine frame.

2. The bench press training machine with variable arms of force of claim 1, wherein the articulating shafts between the swinging arms and the machine frame extend leftward and rightward, and are arranged in a V shape.

3. The bench press training machine with variable arms of force of claim 2, further comprising an assisting mechanism which comprises assisting arms articulated with the machine frame, wherein assisting jacking blocks located below the swinging arms are fixedly connected to the assisting arms, and the assisting mechanism further comprises a driving mechanism configured to drive the assisting jacking blocks on the assisting arms to swing upward.

4. The bench press training machine with variable arms of force of claim 3, wherein the driving mechanism comprises a pedal pull rod which is articulated with the machine frame, the pedal pull rod is connected to the assisting arms, and a rear end of the pedal pull rod extends to a rear of the supporting cushion plate.

5. The bench press training machine with variable arms of force of claim 1, wherein the handles are fixedly connected to rear ends of the swinging arms and are arranged horizontally.

6. The bench press training machine with variable arms of force of claim 5, further comprising an assisting mechanism which comprises assisting arms articulated with the machine frame, wherein assisting jacking blocks located below the swinging arms are fixedly connected to the assisting arms, and the assisting mechanism further comprises a driving mechanism configured to drive the assisting jacking blocks on the assisting arms to swing upward.

7. The bench press training machine with variable arms of force of claim 6, wherein the driving mechanism comprises a pedal pull rod which is articulated with the machine frame, the pedal pull rod is connected to the assisting arms, and a rear end of the pedal pull rod extends to a rear of the supporting cushion plate.

8. The bench press training machine with variable arms of force of claim 1, wherein buffer blocks which support the swinging arms are fixedly connected to the machine frame.

9. The bench press training machine with variable arms of force of claim 8, further comprising an assisting mechanism which comprises assisting arms articulated with the machine frame, wherein assisting jacking blocks located below the swinging arms are fixedly connected to the assisting arms, and the assisting mechanism further comprises a driving mechanism configured to drive the assisting jacking blocks on the assisting arms to swing upward.

10. The bench press training machine with variable arms of force of claim 9, wherein the driving mechanism comprises a pedal pull rod which is articulated with the machine frame, the pedal pull rod is connected to the assisting arms, and a rear end of the pedal pull rod extends to a rear of the supporting cushion plate.

11. The bench press training machine with variable arms of force of claim 1, wherein both ends of each adjusting pull rod are connected through ball joints.

12. The bench press training machine with variable arms of force of claim 11, further comprising an assisting mechanism which comprises assisting arms articulated with the machine frame, wherein assisting jacking blocks located below the swinging arms are fixedly connected to the assisting arms, and the assisting mechanism further comprises a driving mechanism configured to drive the assisting jacking blocks on the assisting arms to swing upward.

13. The bench press training machine with variable arms of force of claim 12, wherein the driving mechanism comprises a pedal pull rod which is articulated with the machine frame, the pedal pull rod is connected to the assisting arms, and a rear end of the pedal pull rod extends to a rear of the supporting cushion plate.

14. The bench press training machine with variable arms of force of claim 1, further comprising an assisting mechanism which comprises assisting arms articulated with the machine frame, wherein assisting jacking blocks located below the swinging arms are fixedly connected to the assisting arms, and the assisting mechanism further comprises a driving mechanism configured to drive the assisting jacking blocks on the assisting arms to swing upward.

15. The bench press training machine with variable arms of force of claim 14, wherein the driving mechanism comprises a pedal pull rod which is articulated with the machine frame, the pedal pull rod is connected to the assisting arms, and a rear end of the pedal pull rod extends to a rear of the supporting cushion plate.

* * * * *